United States Patent [19]

Geller et al.

[11] Patent Number: 4,640,447

[45] Date of Patent: Feb. 3, 1987

[54] MOLTEN METAL IMMERSION POURING SPOUT

[75] Inventors: Heinrich Geller, Duisburg; Peter Nold, Rümmelshein; Heinz Schermer, Eltville; Ortwin Rave, Wiesbaden, all of Fed. Rep. of Germany

[73] Assignee: Didier-Werke AG, Wiesbaden, Fed. Rep. of Germany

[21] Appl. No.: 665,758

[22] Filed: Oct. 29, 1984

[30] Foreign Application Priority Data

Nov. 2, 1983 [DE] Fed. Rep. of Germany ..... 3339586

[51] Int. Cl.[4] ..... B22D 41/08

[52] U.S. Cl. ..... 222/603; 222/607; 164/337

[58] Field of Search ..... 222/603, 591, 606, 607, 222/566, 592, 593; 164/337, 437; 501/132

[56] References Cited

U.S. PATENT DOCUMENTS

| | | | |
|---|---|---|---|
| 1,759,269 | 5/1930 | Morrisson | 164/337 X |
| 3,279,003 | 10/1966 | Yates | 222/591 X |
| 3,801,083 | 4/1974 | Mantey et al. | 266/38 |
| 4,233,079 | 11/1980 | Rechter | 501/132 X |
| 4,356,994 | 11/1982 | Thornton | 222/591 X |
| 4,401,243 | 9/1983 | Diederich et al. | 222/591 |
| 4,423,833 | 1/1984 | Richter | 222/591 |
| 4,531,567 | 7/1985 | Gruner et al. | 222/603 X |

FOREIGN PATENT DOCUMENTS

| | | | |
|---|---|---|---|
| 7005373 | 6/1970 | Fed. Rep. of Germany . | |
| 0042573 | 3/1982 | Japan | 222/591 |

OTHER PUBLICATIONS

Didier-Werke, *Refractory Materials for the Casting Operation,* Catalogue Sheet 5, Nov. 1982, pp. 6–7 and 12–15.

*Primary Examiner*—H. Grant Skaggs
*Assistant Examiner*—Nils Pedersen
*Attorney, Agent, or Firm*—Nils H. Ljungman

[57] ABSTRACT

An immersion pouring spout for introducing molten metal, such as steel, into an ingot mold is provided with a top head and a cylindrical pouring tube including a protective external jacket attached by cement to the pouring tube and extending the entire length of the pouring tube. The jacket material has a thermal conductivity that is less than the thermal conductivity of the pouring tube material.

12 Claims, 3 Drawing Figures

MOLTEN METAL IMMERSION POURING SPOUT

BACKGROUND OF THE INVENTION

1. Field of the Invention

The invention relates to a pouring spout for molten metal, such as steel, which is operative to extend into an ingot mold and through which a charge of molten steel is poured into the ingot mold.

2. Description of the Prior Art

It is known in the prior art to provide a refractory immersion pouring spout as disclosed in German Utility Model DE-GM No. 81 00 896, which corresponds to U.S. Pat. No. 4,423,833, including an upper head portion adapted to be set in an intermediate holder and a pouring tube portion extending out of and below that holder into an ingot mold. An outer protective jacket extends over the height of the pouring tube which is immersed in the molten metal bath within the ingot mold. Consequently, the jacket can only protect the outside surface of the immersion pouring tube against chemical and erosive attacks by the molten steel or by the slag in the region of the top surface of the molten metal bath. The jacket does not reduce the erosion which takes place within the interior of the delivery pouring tube. It has been found, with an immersion pouring spout of this type, that the practical service life of the pouring tube is limited by the internal erosion which occurs above the surface of the molten metal bath.

German Utility Model DE-GM No. 70 05 373 discloses an immersion molten metal pouring spout having an external jacket that extends over most of the height of the pouring tube and which jacket is not cemented to the pouring spout but is connected to it by mechanical means that prevents the jacket from extending over the entire length of the pouring tube. This sheath jacket comprises an exothermic material. The molten steel flowing out of the bottom opening in the immersion pouring spout ignites the exothermic material such that the immersion pouring spout is heated. The molten steel, therefore, does not solidify during the initiation of the pouring of a billet into the ingot mold. In the process, the jacket is consumed and must be renewed before each charge of metal into the ingot mold such that multiple charge service lives cannot be attained. After the jacket has been burned-out, the residual material provides a certain thermal insulation for the immersion pouring spout which is highest for a casting process.

OBJECT OF THE INVENTION

It is an object of this invention to provide an immersion pouring spout which has an extended service life including several molten metal charges with the interior erosion of the spout by the molten metal being substantially reduced.

SUMMARY OF THE INVENTION

The present invention provides a new and improved immersion pouring tube for molten metal, such as steel, for operation with an ingot mold. A protective outer jacket is provided which extends over the entire length of the pouring tube. This jacket is made from a ceramic material whose thermal conductivity is less than that of the said pouring tube. In the event that the pouring spout is to be used for several charges of molten metal into the ingot mold, the protective jacket is cemented on.

By employing an immersion pouring spout provided with a protective jacket that extends over the entire length of the pouring tube, the service life of the pouring spout is increased by reducing the internal erosion.

DESCRIPTION OF THE PREFERRED EMBODIMENTS

Figure 1:
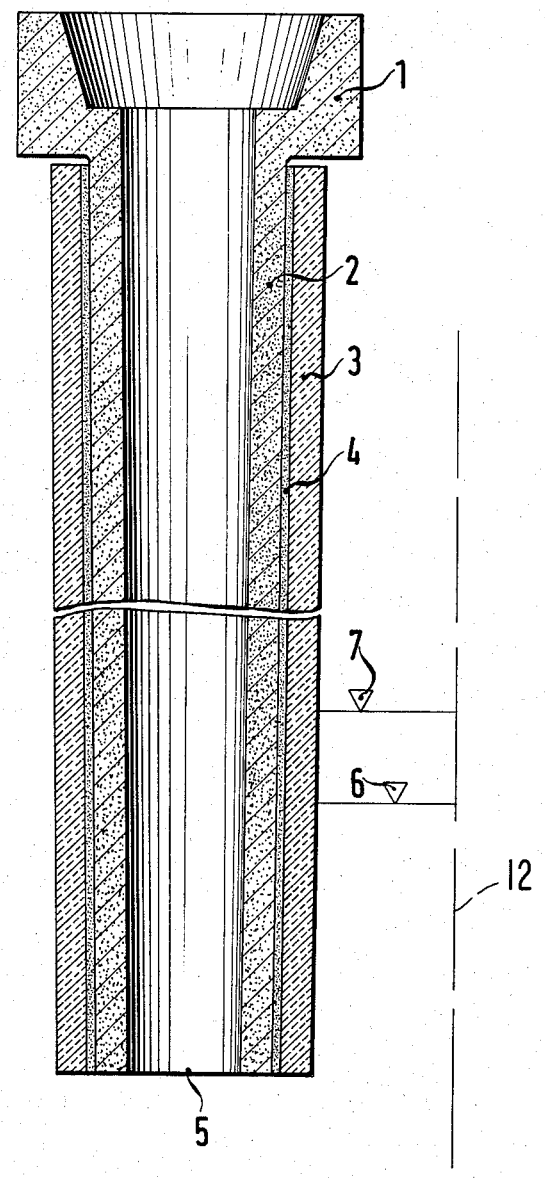
FIG. 1 shows a cross-sectional view of the present immersion pouring spout according to the present invention.

In FIG. 1, according to the invention, there is shown the immersion pouring spout or immersion delivery tube including a head part 1 and a cylindrically shaped pouring tube part 2. The cross-section of the pouring tube part 2 can be circular or oval. In addition, the pouring spout is provided with a protective jacket or casing 3 which is attached external to the pouring tube part 2 by means of a layer of cement 4. The protective jacket 3 extends over the entire height of the pouring tube part 2 from the bottom discharge opening 5 up to the head part 1. The surface 6 of the molten steel within the ingot mold 12 and the surface 7 of the slag are provided during the pouring operation and the protective jacket 3 extends above and below the surfaces 6 and 7.

The pouring tube part 2 and the head part 1 can be made from a single material having a carbon content of 28 to 32% by weight and an alumina content of 85 to 90% by weight, which material is available in the Federal Republic of Germany from the company of Didier-Werke AG under the trade name Grasanit 30-K 691. The protective jacket 3 can be made from a quartz-based material containing 99% by weight of $SiO_2$ and is available in the Federal Republic of Germany also from Didier-Werke AG under the trade name Fondal SX. The thermal conductivity of the pouring tube part 2 is greater than that of the protective jacket 3. For the layer of cement 4, use is made of a refractory cement comprised of densely sintered alumina/corundum, calcined alumina and refractory clay, with a mono-aluminum phosphate solution and/or phosphoric acid as a binding agent, with the cement containing 18 to 23% by weight of finely divided green chromium-(III)oxide. The layer of cement 4 may contain a refractory with a base of alumina, fireclay and an inorganic phosphate bonding agent. The wall thickness of the protective jacket 3 is about the same as that of the pouring tube part 2, and in the order of 10 mm.

The immersion pouring spout can be used without the protective jacket 3. In such a case, it can be used, for example, for up to four charges of molten metal into the ingot mold 12. If it is required to pour more than four charges, such as seven charges, the protective jacket 3 is then cemented to the pouring tube part 2. Below the surface 7, the protective jacket 3 protects the pouring tube part 2 from chemical and erosive attack by the slag or by the steel. Above the surface 7, due to its thermal insulation properties, the protective jacket 3 reduces the cooling of the pouring tube part 2. Consequently, the interior of the pouring tube part 2 is smeared to such a small extent that even after the protective jacket 3 has been completely used up, the pouring tube part 2 is not rendered unusable because of external or internal erosion. Therefore, it is available for the casting of additional charges.

Figure 2:
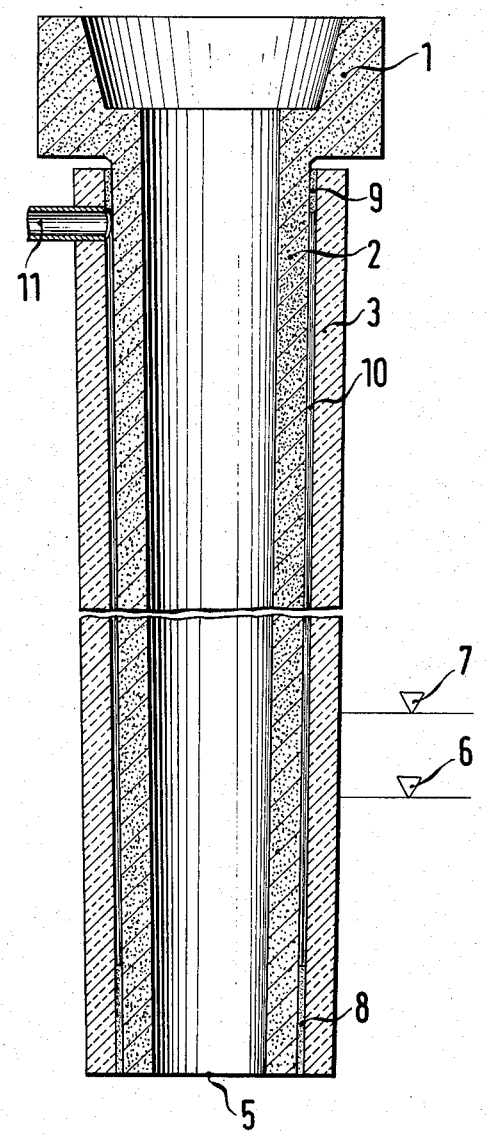
FIG. 2 shows a modification of the present immersion pouring spout according to the present invention.

In the modification embodiment shown in FIG. 2, the protective jacket 3 is connected to the pouring tube part 2 by only a lower cement layer 8 and an upper cement layer 9. Between the two cement layers 8 and 9 is a hollow space 10. Passing through the protective jacket 3 is a gas connector 11 which opens into the hollow space 10. An inert gas such as argon, for example, is blown into the hollow space 10 through the gas connector 11. The blown-in gas reduces the flow of heat from the pouring tube part 2 to the protective jacket 3. The thermal insulating effect is thereby improved.

The pouring tube part 2 made of Grasanit material is permeable to gases while, on the other hand, the protective jacket 3 made of Fondal material is impermeable. Advantageously, the gas is blown into the hollow space 10 at such a pressure that it passes inward through the walls of the pouring tube part 2. As a result, within the pouring tube part 2, the steel is flushed with gas. In addition, the gas-flushing action prevents deposits from forming on the interior surface of the tube. With this arrangement it is also possible to carry out a gas flushing operation even with small immersion pouring spouts.

Figure 3:
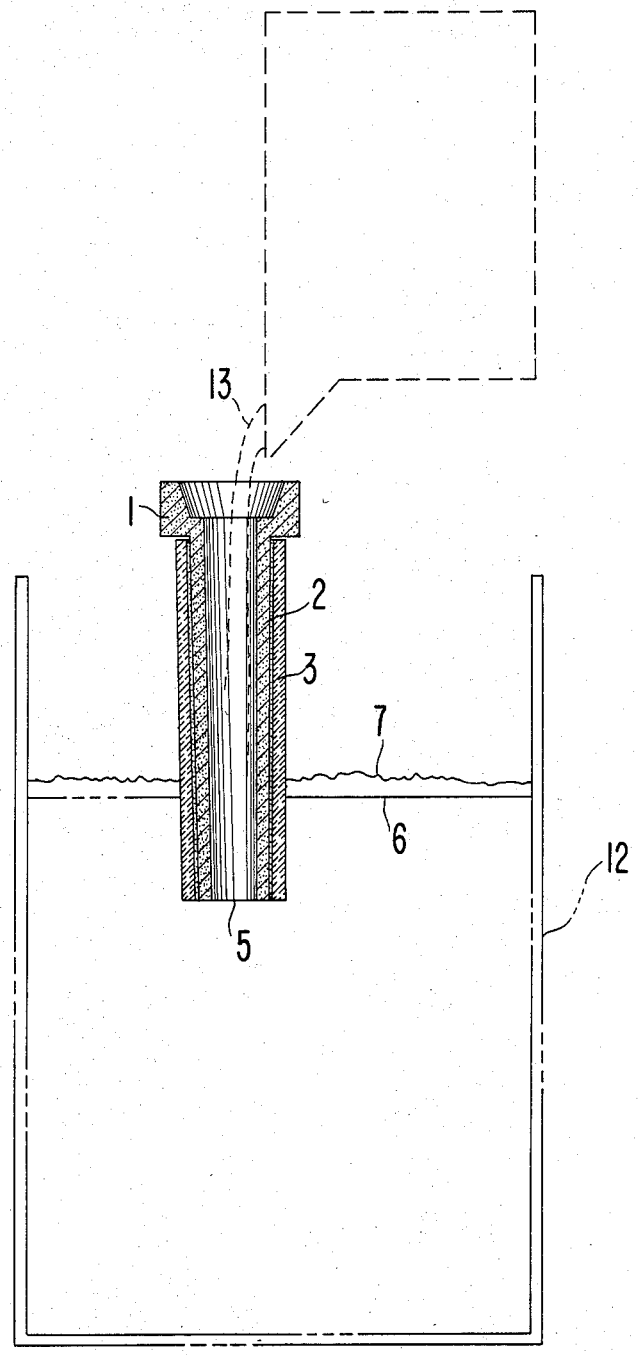
FIG. 3 schematically shows the present pouring spout operative with an ingot mold according to the present invention.

In FIG. 3 there is schematically shown the head part 1 and pouring tube part 2 of the present immersion pouring spout positioned within an ingot mold 12 for controlling the movement of molten metal 13 into the ingot mold 12. The protective jacket 3 extends above and below the surface 6 of the molten metal and the surface 7 of the slag. The protective jacket 3 protects the pouring tube part 2 at the surface level 6 of the molten metal bath from the chemical and erosive attacks caused by the molten steel and the slag. On the other hand, above the surface 6 of the molten metal bath, the protective jacket 3 provides thermal insulation for the pouring tube part 2. As a result, the portion of the pouring tube part 2 located above the surface 6 of the molten metal undergoes scarcely any cooling, so that the steel 13 which flows through it does not smear its interior surface. This connotes a reduction in the interior erosion.

Consequently, an immersion pouring spout fitted with the protective jacket 3 can be used for appreciably more molten metal charges into ingot molds than a pouring spout with no protective jacket 3. Moreover, the service life is also extended when pouring "killed" steel, especially aluminum-killed steel, during which the pouring tube part 2 rapidly becomes smeared.

In a preferred embodiment of the invention, the pouring tube part 2 comprises a material with an alumina content of 65 to 90% by weight and a carbon content of 20 to 32% by weight, such a material is sold under the trade name Grasanit. The protective jacket 3 preferably comprises a quartz-based material with an $SiO_2$ content of about 99% by weight, such a material is sold under the trade name Fondal.

A pouring tube part 2 of Grasanit erodes less quickly than would a pouring tube part 2 of Fondal. On the other hand, a pouring tube part 2 of Grasanit smears faster than would a pouring tube part 2 of Fondal. This is particularly true when pouring "killed" steel, especially aluminum "killed" steel. This cause of the smearing is to be seen in the high thermal conductivity of the Grasanit by comparison with Fondal. In the pairing of the materials in accordance with the present invention, the positive properties of the two materials are advantageously combined. The protective jacket 3 of Fondal insulates the pouring tube part 2 of Grasanit, so that the latter is smeared less.

Preferably, the layer of cement 4 used to attach the protective jacket 3 to the pouring tube part 2 is chemically removable alumina-rich cement which, in the embodiment of the invention, contains about 18 to 23% by weight of chromium(III)oxide, $Cr_2O_3$. This layer of cement 4 also ensures a solid bond at high temperatures. The addition of the chromium oxide prevents the steel from penetrating the joint between the protective jacket 3 and the pouring tube part 2.

The invention is not to be taken as limited to all the details that are described hereinabove, since modifications and variations thereof may be made without departing from the spirit or scope of the invention.

What is claimed is:

1. An immersion pouring spout for molten metal, comprising:

a top first part;

a cylindrically-shaped second part having an outside surface and coupled with said top first part to be operative as a pouring tube; and a protective jacket made of a ceramic material protecting said outside surface of said second part, and cement layer means attaching said jacket to said second part such that said protective jacket extends over substantially the entire length of said second part, said cement layer means comprising a material whose thermal conductivity is less than the thermal conductivity of said pouring tube, said second part having a bottom outlet for molten metal, and with said cement layer means including a first portion positioned adjacent to said top first part and a second portion positioned adjacent to said bottom outlet such that a space is provided between said second part and said protective jacket and between said first and second portions of said cement layer means.

2. The immersion pouring spout in accordance with claim 1, wherein said second part comprises a material with an alumina content of 65 to 90% by weight, and with said protective jacket comprising a quartz material containing about 99% by weight of $SiO_2$.

3. The immersion pouring spout in accordance with claim 1, wherein said cement layer means by which said protective jacket is attached to said second part comprises a chemically removable alumina-rich cement containing about 18 to 23% by weight of chromium(III)oxide.

4. The immersion pouring spout in accordance with claim 1, wherein said protective jacket has a first wall thickness and said second part has a second wall thickness, and with said first wall thickness being at least as great as said second wall thickness.

5. The immersion pouring spout in accordance with claim 1, wherein said protective jacket includes a connection through which an inert gas can be blown into said space.

6. The immersion pouring spout in accordance with claim 5, wherein said gas is blown with such a pressure into said space that said gas passes through said second part.

7. An immersion pouring spout for molten metal, said spout comprising:

a top first part;

a cylindrically-shaped second part having an outside surface and coupled with said top first part to be operative as a pouring tube; and a protective jacket made of a ceramic material protecting said outside surface of said second part, and cement layer means attaching said jacket to said second part such that said protective jacket extends over substantially the entire length of said second part, said cement layer means comprising a material whose thermal conductivity is less than the thermal conductivity of said pouring tube, wherein said cement layer means comprises a first portion positioned adjacent to said top first part and a second portion positioned adjacent to a bottom outlet of said second part, such that a space is provided between said second part and said protective jacket and between said first and second portions of said cement layer means.

8. The immersion pouring spout in accordance with claim 7, wherein said protective jacket includes a connection through which an inert gas can be blown into said space.

9. The immersion pouring spout in accordance with claim 8, wherein said gas is blown with such a pressure into said space that said gas passes through said second part.

10. The immersion pouring spout in accordance with claim 7, wherein said second part comprises a material with an alumina content of 65 to 90% by weight, and with said protective jacket comprising a quartz material containing about 99% by weight of $SiO_2$.

11. The immersion pouring spout in accordance with claim 7, wherein said cement layer means by which said protective jacket is attached to said second part comprises a chemically removable alumina-rich cement containing about 18 to 23% by weight of chromium (III) oxide.

12. The immersion pouring spout in accordance with claim 7, wherein said protective jacket has a first wall thickness and said second part has a second wall thickness, and with said first wall thickness being at least as great as said second wall thickness.

* * * * *